United States Patent [19]

Noel

[11] 3,960,162

[45] June 1, 1976

[54] VENTED UMBRELLA

[76] Inventor: Francois Gilbert Noel, 1719 Nostrand Ave., Brooklyn, N.Y. 11226

[22] Filed: Mar. 19, 1975

[21] Appl. No.: 559,905

[52] U.S. Cl. ..... 135/35 V; 135/14 V
[51] Int. Cl.[2] ..... A45B 25/22; A45B 25/26
[58] Field of Search ..... 135/2, 14 V, 35 V

[56] References Cited

UNITED STATES PATENTS

| | | | |
|---|---|---|---|
| 1,723,044 | 8/1929 | Khalil | 135/35 V |
| 3,456,661 | 7/1969 | Farley | 135/35 V |
| 3,874,397 | 4/1975 | Oberhaus | 135/14 V |

FOREIGN PATENTS OR APPLICATIONS

| | | | |
|---|---|---|---|
| 106,457 | 1/1927 | Austria | 135/35 V |

*Primary Examiner*—Werner H. Schroeder
*Assistant Examiner*—Conrad L. Berman

[57] ABSTRACT

An umbrella having uniquely designed and located vents for the protection of its structural components when used in open spaces where winds of medium and high velocities are encountered. The vents comprise pivotal flaps fabricated of semi rigid material and resiliently seamed to the ribs being caused to open due to air pressure exerted against the underside of the umbrella sufficient to cause the ribs to flex in the normal manner under such conditions. The vent attachments to the ribs are located at a distance from the peak of the umbrella near the swinging connections of the ribs and struts whereby pressure on both components may be relieved at these critical points.

1 Claim, 4 Drawing Figures

FIG. 1
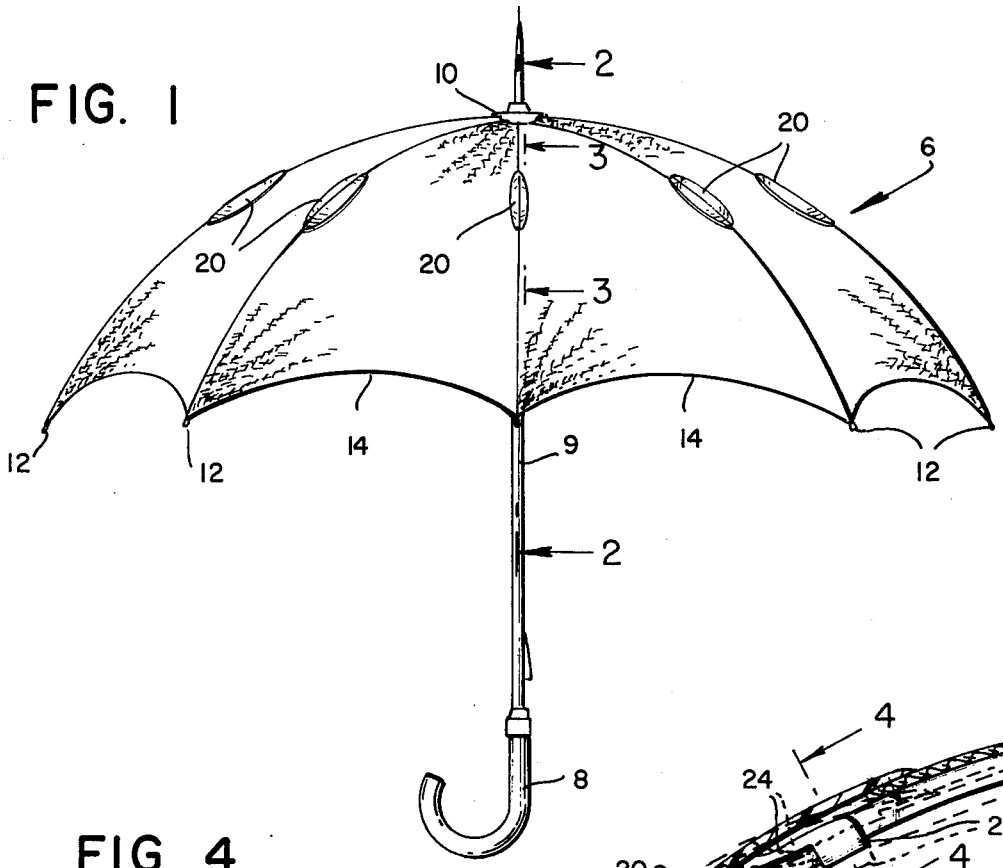
FIG. 4
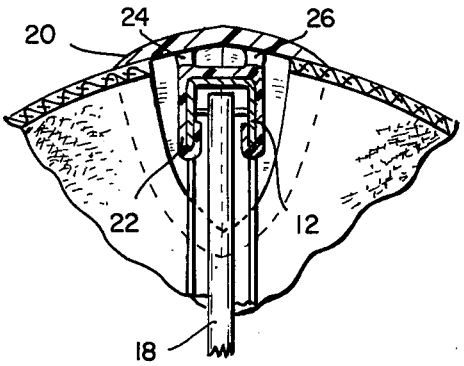
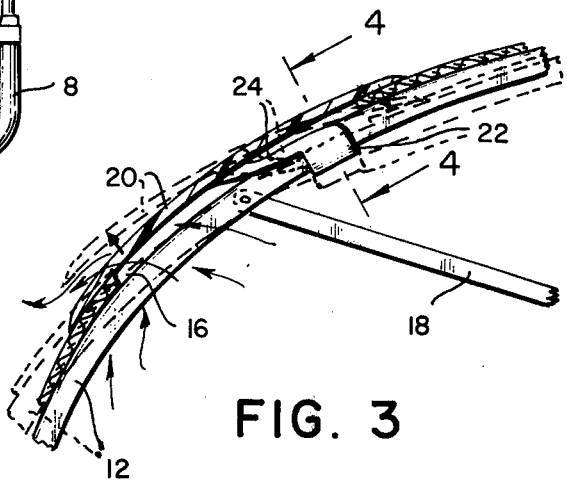
FIG. 3
FIG. 2
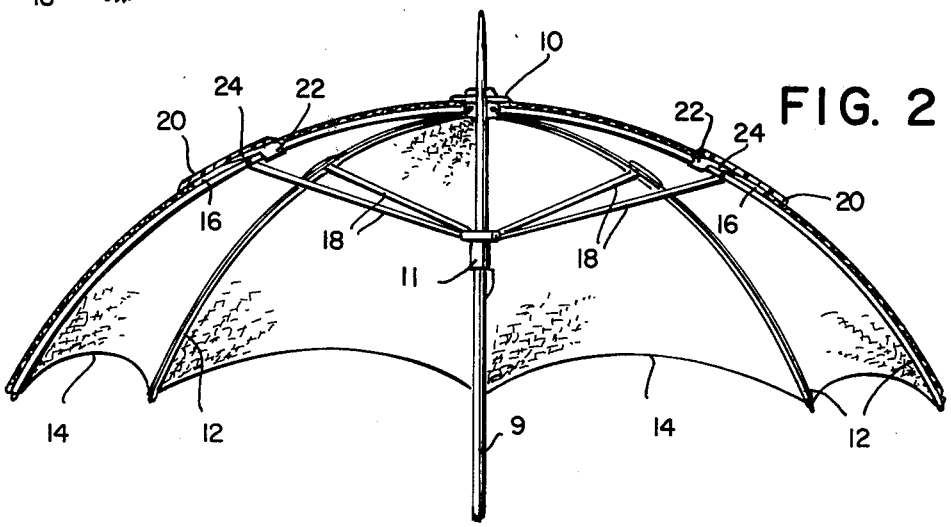

VENTED UMBRELLA

The invention relates to umbrellas and like structures and, in particular, to umbrellas which are specially vented to minimize the risk of their destruction in high winds.

Umbrellas having covered openings arranged to vent collected air under given conditions to the outside are known. See, for example, U.S. Pat. No. 3,032,047. For the most part these devices have their venting components located at the peak adjacent the connection of the handle extension and umbrella shield. In the present case there are provided multiple vents which are adapted to flex and open under sufficient air pressure within the opened umbrella, the vents being located in the vicinity of the structural component connections where the umbrella is perhaps most vulnerable to breakage under conditions of stress. The vents are mechanically associated with these components in such a manner that their flexing under stress at points removed from the vents themselves causes them to open sufficiently to relieve such stress tending to restore the umbrella to its normal state. In addition, the vents will be caused to open under a relatively light air pressure applied directly thereto, such opening in either case being directed away from the umbrella top against which rain water would normally be making impact and would otherwise flow through the open vents thus exposing the user.

One object of the invention is to provide an improved umbrella structure having vents for the protection of its integrity under stress conditions.

Other objects and advantages of the invention may be appreciated on reading the following description of one embodiment thereof which is taken in conjunction with the accompanying drawings, in which:

FIG. 1 is an elevation view of the new and improved umbrella;

FIG. 2 is a section taken on line 2—2 of FIG. 1;

FIG. 3 is an enlarged section taken on line 3—3 of FIG. 1 showing the mechanical details of the improved umbrella vent; and FIG. 4 is a section taken on the line 4—4 of FIG. 3.

Referring to the drawings umbrella 6 has a conventional handle portion 8 having a staff extension 9 near the top of which there is fixedly mounted a stationary ring 10. Secured to and radially extending from the ring

10 are downwardly curved ribs 12. A silk or other flexible material 14 is stretched over the ribs 12 being attached at their ends for supporting the ribs in the generally radial disposition. Approximately intermediate the ring attached and free ends of the ribs are openings 16 formed in the silken material over each rib.

Slidably mounted on the handle 8 underneath the ring 10 is sleeve member 11 to which struts 18 are pivotally connected. The opposite ends of the struts are swingably connected to the ribs 12 underneath the openings 16.

Over each of the openings 16 is a vent 20 held in place by U-shaped clamp 22 which partially envelopes rib 12 as shown in FIG. 4. Flexible spring arms 24 and 26 connect the sides of the clamp 22 to the vent 20. In strong winds the ribs below the strut connection will flex upwardly, and above the connections will be caused to flex in the downward direction, as shown in broken line in FIG. 3, which causes the lower end of the vents to open slightly as shown. Relatively light air pressure may also cause the vents to open, the pressure being exerted directly to their undersides. It is seen that at the very points where the pressure could cause a rupture of the structural members, the vents in their general area will automatically open to relieve the pressure and thus minimize the risk of rupture in the very region where such risk is highest.

Various modifications of the invention may be effected by persons skilled in the art without departing from the scope and principle thereof as defined in the appended claims.

What is claimed is:

1. An umbrella comprising a handle and extension member, ribs secured to and radiating from said member, a cover made of flexible material disposed over said ribs, pivotal struts connected to the ribs and slidably mounted on said member, said cover having at least one opening located below the peak of said umbrella, said opening being located over the pivotal connection of one of said ribs and struts, a clamp embracing said one rib at one end of said opening, a vent adapted to cover said opening, and a flexible arm connecting said clamp and said vent whereby on the outward flexing of said rib below said vent the rib will be flexed downwardly above said vent and cause said arm to automatically open the vent and relieve the pressure on the pivotal connection of said rib and strut.

* * * * *